United States Patent [19]

Tuschy et al.

[11] 4,178,785

[45] Dec. 18, 1979

[54] SKEW ROLLING MILL

[75] Inventors: Eckhard Tuschy; Georg Wischmeyer, both of Osnabruck, Fed. Rep. of Germany

[73] Assignee: Kabel-und Metallwerke Gutehoffnungshuette AG, Fed. Rep. of Germany

[21] Appl. No.: 888,204

[22] Filed: Mar. 20, 1978

[30] Foreign Application Priority Data

Mar. 21, 1977 [DE] Fed. Rep. of Germany ..... 2712245

[51] Int. Cl.[2] ..... B21B 13/00

[52] U.S. Cl. ..... 72/78

[58] Field of Search ..... 72/77, 78, 95, 100

[56] References Cited

U.S. PATENT DOCUMENTS

| | | | |
|---|---|---|---|
| 644,919 | 3/1900 | Illingworth | 72/78 |
| 1,184,972 | 5/1916 | Lloyd | 72/69 |
| 3,014,519 | 12/1961 | Wright | 72/78 |
| 3,132,545 | 5/1964 | Arata | 72/100 |

*Primary Examiner*—Lowell A. Larson

*Attorney, Agent, or Firm*—James C. Jangarathis

[57] ABSTRACT

A skew rolling mill is provided with a deforming smoothing means in contact with the stock immediately beyond the working rollers to remove markings. The deforming means is supported in a support which rotates about the axis of the stock.

3 Claims, 1 Drawing Figure

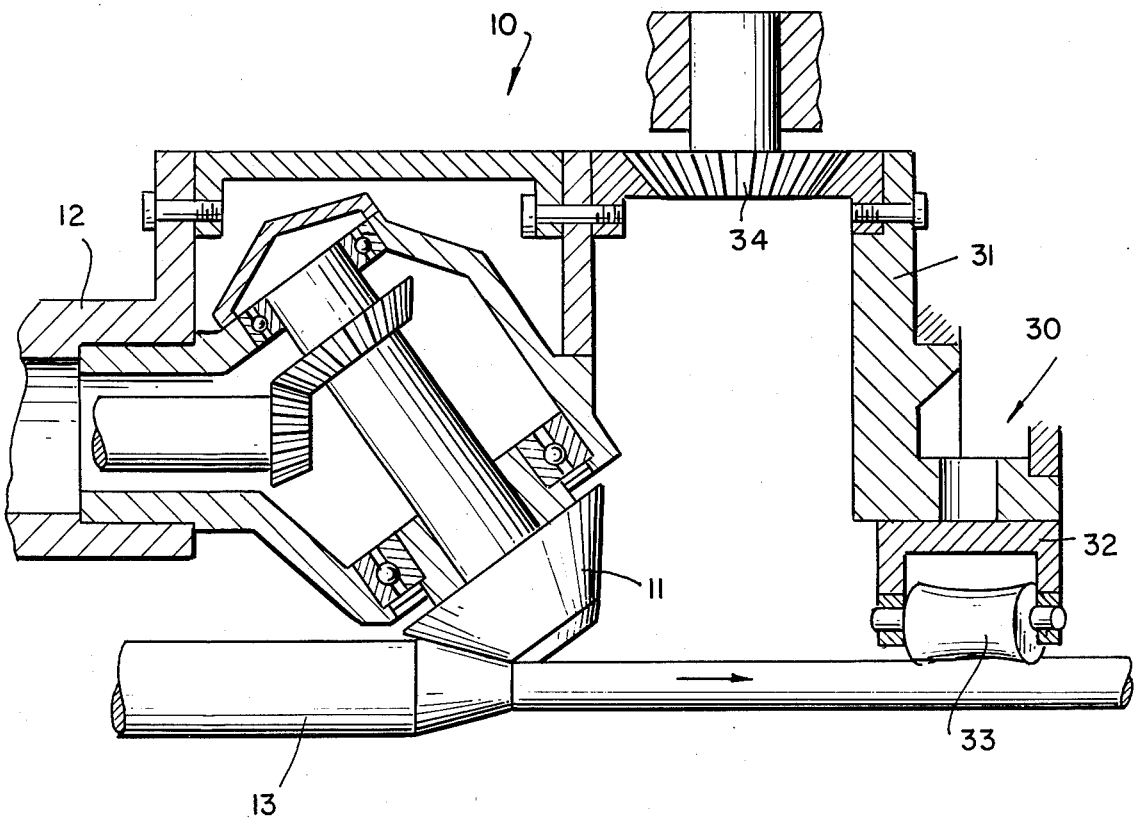
10
12
34
31
30
32
11
33
13

SKEW ROLLING MILL

This invention relates to skew rolling mills of the type described in U.S. Pat. No. 3,735,617.

Such skew rolling mills include a driven roller carrier mounted on a hollow axle through which longitudinally extending material is moved. The roller carrier carries driven working rollers which are inclined with respect to the roller axis. These reduce the stock diameter.

In such skew rolling mills, helical markings are formed on the surface of the rolled material. Such markings should be removed from the surface.

In accordance with the present invention, there is provided a skew rolling mill having a deforming means immediately beyond the working rollers, with the deforming means engaging the rolled material to remove such markings. The deforming means is driven, preferably by the roller carrier (at the same or different speed), with the deforming means being driven in a direction opposite to the direction of the roller carrier; i.e., the deforming means is rotated in a direction opposite to the direction of rotation of the roller carrier.

The rotatable deforming means is preferably mounted on the roller carrier, thereby providing a helical deformation force on the rolled material as it is discharged from the working rollers of the mill.

The deforming means for smoothing the rolled stock preferably engages the stock through freely rotating roller means (preferably two rollers) which roll against (off of) the surface of the rolled stock. The deforming forces applied by such deforming smoothing means are low and the roller elements which engage the stock transmit little frictional force, whereby there is a minimal torsion force on the rolled stock.

It may be advantageous also to remove projections produced during the rolling, and this may be accomplished in a subsequent operation; e.g., a rotating lathe tool, shaving tool, brushes, etc.

The invention will be further described with respect to the accompanying drawing wherein:

The drawing is a simplified vertical sectional view of an embodiment of a rolling mill incorporating the present invention.

Referring to the drawing, there is shown a rolling mill 10, which includes at least two driven frustroconically shaped working rollers 11 which are rotatably driven in roller carrier 12 about an axis which intersects that of the stock to be rolled. The roller carrier is rotatably driven about the axis of the stock 13 which is to be rolled. The working rollers 11 reduce the cross section of the stock and, as a result of the angular displacement thereof with respect to the axis of the stock, such rollers 11 move the stock in the direction of the arrow.

The construction and operation of such a rolling mill is described in U.S. Pat. No. 3,735,617 and no further details in this respect are needed for a complete understanding of the invention.

In accordance with the present invention there is provided a deforming means 30 for smoothing the rolled stock and removing markings therefrom which includes a frame 31, roller support 32 and freely rotating smoothing rollers 33. The frame 31 is rotated about the axis of the stock in a direction opposite to the direction of rotation of the roller housing through a reversing gear 34.

The smoothing rollers 33 have the longitudinal axis thereof angularly displaced with respect to the longitudinal axis of the stock; the rotation axis of the rollers is angularly displaced and does not intersect the axis of the stock. The smoothing rollers 33 have a concave working surface so as to maintain a linear engagement with the stock for removing markings therefrom.

Although the embodiment has been particularly described with respect to effecting rotation of the deforming smoothing means through the roller housing, such rotation could be effected independently, although such a construction is less preferable.

Such modifications and others are deemed to be within the scope of those skilled in the art from the teachings herein and, accordingly, the scope of the invention is not limited to such an embodiment.

We claim:

1. In a skew rolling mill for cross section reduction of an elongated stock as it moves along a longitudinal axis without rotation about such axis, comprising:

a roller support means mounted for rotation about said longitudinal axis;

a plurality of working rollers mounted within said roll support means and symmetrically about said longitudinal axis, each of said rollers being mounted for rotation about a secondary axis which intersects the elongated stock;

primary means for rotating said roll support means in a first direction; and first intermediate means for rotating said rollers about said secondary axis and into the surface of said elongated stock for reducing the cross section of said stock, the improvement comprising:

a deforming means for smoothing helically shaped protrusions and grooves caused by said working rollers in the surface of the elongated stock, said deforming means including:

frame means adapted to be rotated about said longitudinal axis;

second intermediate means for rotating said frame means; and freely rotating smoothing rollers supported by said frame means, each having a longitudinal axis angularly displaced and not intersecting said longitudinal axis, and having a concave surface to maintain a linear engagement with helically shaped protrusions and groove markings in the surface of said elongated stock caused by said working rollers.

2. The skew rolling mill of claim 1 wherein said frame means is rotated about said longitudinal axis in a direction opposite to the direction of rotation of said roller support means.

3. The skew rolling mill of claim 2 wherein said frame means is supported by and driven through said roller support means at the same speed of rotation.

* * * * *